United States Patent [19]

Bell et al.

[11] 4,002,126

[45] Jan. 11, 1977

[54] PALLET CONSTRUCTION

[75] Inventors: Ferris Andrew Bell, St. Louis County, Mo.; Thomas N. DePew, 10 Sunningdale, St. Louis County, Mo. 63124

[73] Assignee: said Thomas N. DePew, by said Ferris Andrew Bell, St. Louis, Mo.

[22] Filed: Nov. 11, 1974

[21] Appl. No.: 522,575

[52] U.S. Cl. ..... 108/53.5; 214/10.5 R

[51] Int. Cl.[2] ..... B65D 19/40

[58] Field of Search ..... 108/51–58; 211/177; 214/10.5 R

[56] References Cited

UNITED STATES PATENTS

| | | | |
|---|---|---|---|
| 2,648,455 | 8/1953 | Bitney | 108/55 X |
| 2,738,940 | 3/1956 | Coit, Jr. | 108/53 |
| 2,828,932 | 4/1958 | DePew et al. | 108/55 |
| 2,828,933 | 4/1958 | DePew et al. | 108/55 |
| 3,114,339 | 12/1963 | Bayluk | 108/53 |
| 3,442,231 | 5/1969 | Jurasek | 108/53 |
| 3,500,770 | 3/1970 | Skubic | 108/53 |
| 3,576,169 | 4/1971 | DePew | 108/53 |
| 3,762,344 | 10/1973 | Chez | 108/51 X |
| 3,857,494 | 12/1974 | Giardini | 108/53 X |

*Primary Examiner*—Roy D. Frazier
*Assistant Examiner*—William E. Lyddane
*Attorney, Agent, or Firm*—Ralph W. Kalish

[57] ABSTRACT

A pallet construction for use with detachable tiering frames, which pallet is fabricated of metal having parallel stringers with a plurality of longitudinally spaced-apart deck members extending transversely therebetween which latter are fixed, as by welding, to said stringers. Said pallet may be adapted for use with tiering frames of the center post or corner post type by means of a unique support member fixed, in the former case, to the intermediate zone of the under face of the stringers and end deck members, and in the latter case to the ends of said stringers. Said supports each incorporate a surface bearing portion for engaging a portion of the underlying tiering frame; there being an adjacent inclined portion which serves as a detent to inhibit shifting of the pallet as so supported while also acting cammingly to assist in positioning of such pallet. Each support has a base portion for engaging a support surface.

8 Claims, 14 Drawing Figures

FIG.6
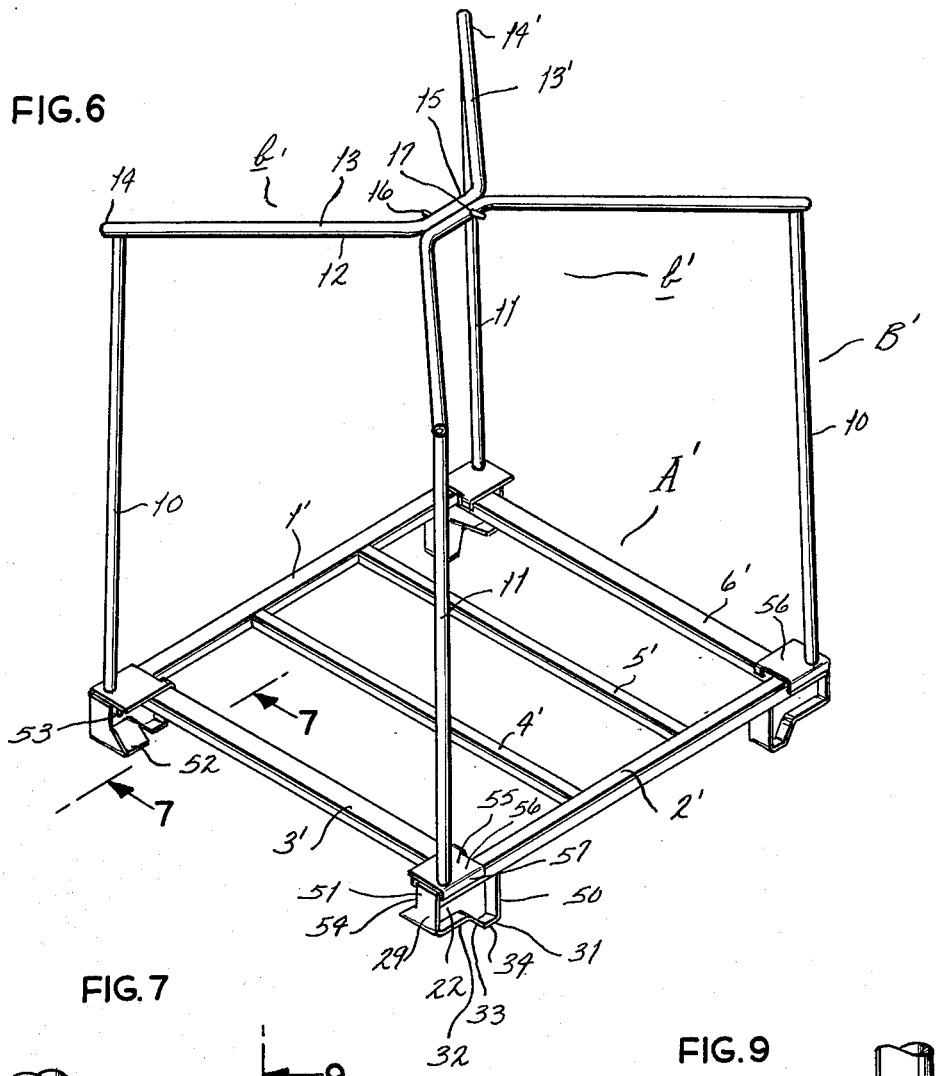
FIG.7
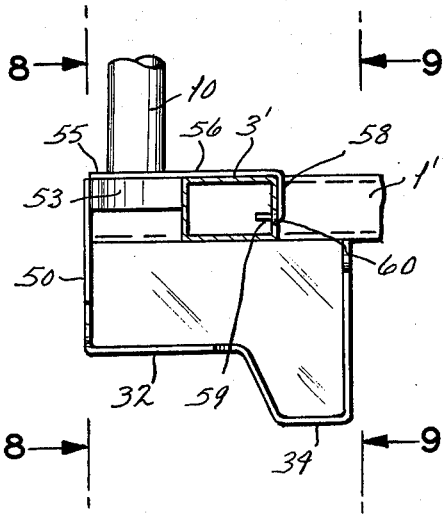
FIG.9
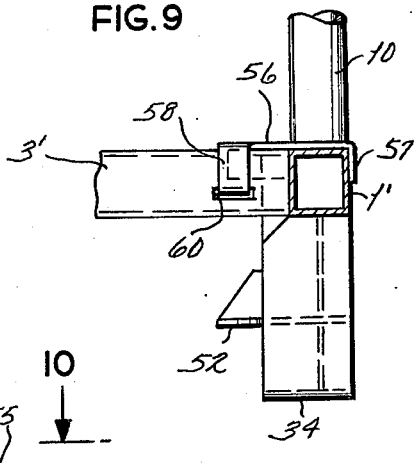
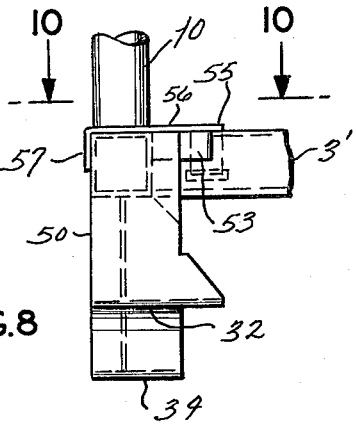
FIG.8

PALLET CONSTRUCTION

BACKGROUND AND SUMMARY OF THE INVENTION

This invention relates in general to material handling equipment and, more particularly, to certain new and useful improvements in loading pallet constructions.

Heretofore, for the most part pallets for industrial usage have been fabricated of wood. However, currently the cost of wood has materially increased so that the same is not presently economic for pallet construction, particularly in light of the limited life of a wooden pallet due to the inordinately customary rough handling of the same as particularly by fork lift trucks.

Therefore, it is an object of the present invention to provide a pallet fabricated from metal and desirably from tubular stock with the components being so arranged as to be minimal in number, while providing marked strength so as to be resistant to the usual wear to which loading pallets are subjected in usage.

It is another object of the present invention to provide pallets of the type stated which are of a single deck type so as to limit the amount of metal required, but which are uniquely adapted for manipulation and handling by fork lift trucks.

It is a still further object of the present invention to provide a pallet of the character stated which is particularly designed for utilization with pallet tiering frames so as to be incorporated in tiered relationship for load support within minimal storage volume.

It is another object of the present invention to provide a pallet of the character stated which embodies novel components for promoting the supported disposition of the same upon tiering frames, thereby facilitating the manipulation process.

It is a still further object of the present invention to provide a pallet of the character stated which incorporates components adapted to inhibit shifting or otherwise displacement of the pallet when in supported condition thereby assuring of maximum stability of tiered loads.

It is a still further object of the present invention to provide a pallet of the character stated which embodies elements for detachable interlocking engagement with the foot portions of pallet tiering frames so that reliable gripping is effected.

It is a still further object of the present invention to provide a pallet of the character stated which is extremely durable in usage; being resistant to the damage normally inflicted upon pallets through the usual careless handling; which, as indicated, has proved economical in production; and which is amenable to simple design alterations for accommodating loads of all types.

BRIEF DESCRIPTION OF THE DRAWINGS

FIG. 6 is a perspective view of another form of pallet constructed in accordance with the present invention, illustrating same with a tiering frame detachably mounted thereon.

FIG. 7 is a vertical transverse sectional view taken on the line 7—7 of FIG. 6.

FIG. 8 is a view taken on the line 8—8 of FIG. 7.

FIG. 9 is a vertical transverse sectional view taken on the line 9—9 of FIG. 7.

DESCRIPTION OF PRACTICAL EMBODIMENTS

Figure 1:
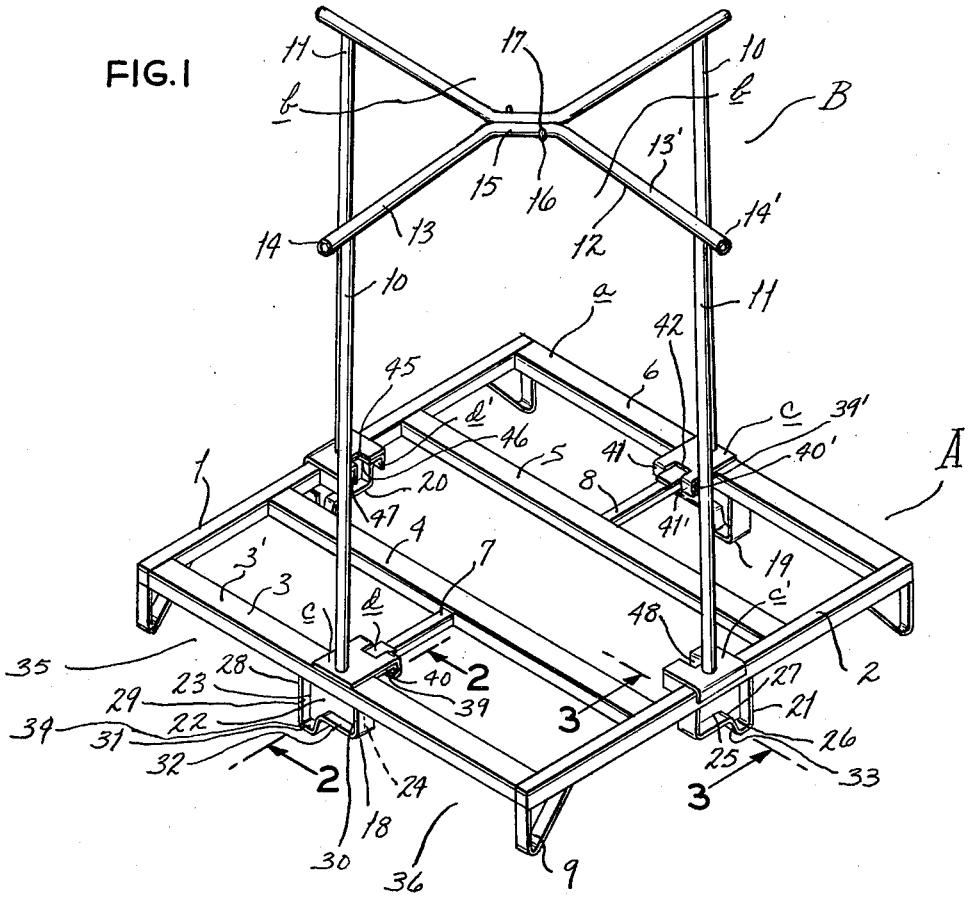
FIG. 1 is a perspective view of a pallet constructed in accordance with and embodying the present invention illustrating same with a tiering frame detachably mounted thereon.

Referring now by reference characters to the drawings which illustrate practical embodiments of the present invention, A designates a storage or loading pallet for industrial usage formed of metal stock comprising a deck area, generally indicated *a*, designed by parallel stringers or side components 1, 2 being desirably of tubular stock and square in cross-section. Between said stringers 1, 2 extend a plurality of axially parallel, longitudinally spaced-apart deck members 3, 4, 5, 6; the latter being constructed also of tubular stock, but having a rectangular cross-section to provide relatively wide upper, load-bearing surfaces as at 3'. Deck members 3, 4, 5, 6 are rigid with stringers 1, 2, as by welding, and are flush therewith on their upper and lower surfaces. Further rigidifying pallet A are braces 7, 8 extending between, and fixed at their ends to deck members 3, 4 and 5, 6, respectively, in their intermediate zones; said braces 7, 8 being also of tubular stock and presented in axially parallel relationship with stringers 1, 2. The number of deck members that pallet A may incorporate is a matter of choice with the same being dictated by the overall area, the requirements of the particular load, etc. However, pallets conforming to the one illustrated in FIG. 1 are adequate for the normal range of dimensions in current usage. Pallet A is thus sturdy, yet despite the utilization of metal, is relatively of lightweight so that handling of the same is as equally facile as with pallets constructed of other materials, such as wood, plastic, etc.

Depending from each stringer 1, 2 at each of its ends is a standard 9 of such height as to present the under surface of pallet A at a distance from the support surface, such as the ground, floor, as the case may be, adequate to permit the insertion of tines of a fork lift truck thereunder for transporting of, or otherwise handling, pallet A together with any applied load. Said standards 9 may be of any suitable character but are illustrated herein as being easily formed from predetermined lengths of elongated strip stock into general V-shape and with the respective ends of such lengths being fixed, as by welding, to the adjacent stringer. Said standards 9 being located at the corners of pallet A, thus serve to stabilize the same rendering same resistant to any undesired tilting or rocking movement.

Pallet A is adapted for use with a tiering frame B, detachably mountable upon said pallet A, being of the so-called center post type, that is, wherein the posts or uprights 10, 11 of each of the cooperating, normally identical frame components *b*, are located at zones substantially intermediate the sides of the pallet, as distinguished from the corners thereof, whereby said posts 10, 11 cooperate to delineate quarter storage sections or quadrants of the pallet; allowing of access to the particular load through the open corners. Pallet tiering frame B is of the type set forth and described in U.S. Pat. No. 2,828,933 wherein each component *b* incorporates a generally V-shaped upper or top element 12 having leg portions 13, 13' which are fixed in their outer portions upon the related posts 10, 11 and embodying end extensions 14, 14'. At their inner ends the cooperating legs 13, 13' are connected by a short intermediate portion 15 provided with a pin 16 and aperture 17 in side-by-side relationship for interengagement with the corresponding components of the upper or top element of the other frame *b*. It will thus be seen that the engaged upper elements 12 define a load support which is in planar parallel relationship to the plane of pallet A, that is, of deck members 3, 4, 5 and 6.

Fixed to each and deck member 3, 6 and stringer 1, 2, intermediate their length for dependence from the underside thereof, directly beneath the region of engagement of the proximate tiering frame posts 10, 11, is a support 18, 19, 20, 21, respectively, each of which comprises a vertical web 22, having vertical side edges 23, 24 of different length, with the former being longer than the latter, and having a bottom edge which incorporates an upper rectilinear portion 25, progressing from end edge 24 and being connected to a lower, axially parallel, relatively shorter horizontal portion 26 by an intervening downwardly inclined, endwise portion 27. Each web 23 is provided with a flange, generally indicated 28, conforming to the end and bottom edge portions of said web and having a transverse extent substantially equivalent to that of the overlying deck member or stringer, as the case may be, there thus being end flange portions 29, 30 adjacent web end portions 23, 24, respectively, and a bottom flange 31 having an upper horizontal portion 32 corresponding to web bottom edge portion 25, an inclined portion 33, and a relatively shorter horizontal portion 34. Each web 22 and its associated flange 28 is so dimensioned that lower flange portion 34 will normally rest upon the support surface in alignment with standards 9 and thereby provide increased stability of said pallet A. It will furthermore be noted that by means of their particular location, said supports 18, 19, 20, 21 cooperate with the adjacent standards 9 to define intermediate openings on either side, as shown for example at 35, 36 to serve as guideways for fork lift truck tines; with pallet A being thus of the four-way entry type.

Figure 5:
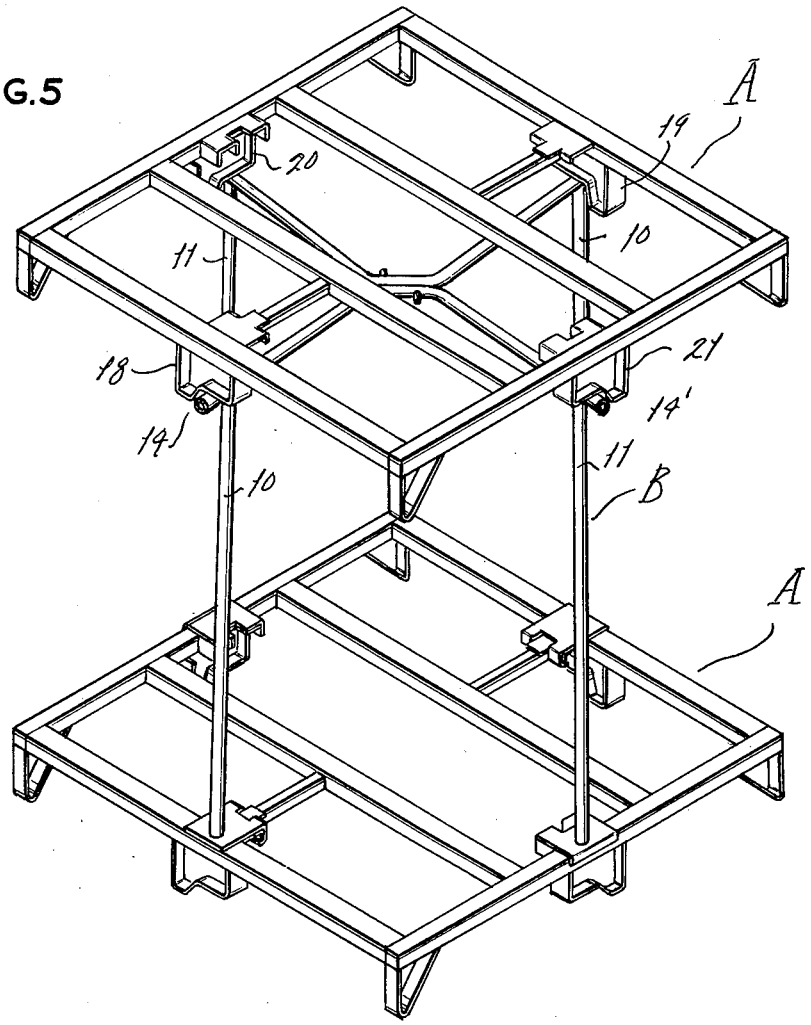
FIG. 5 is a perspective view illustrating a pair of pallets in stacked relationship.
Figure 4:
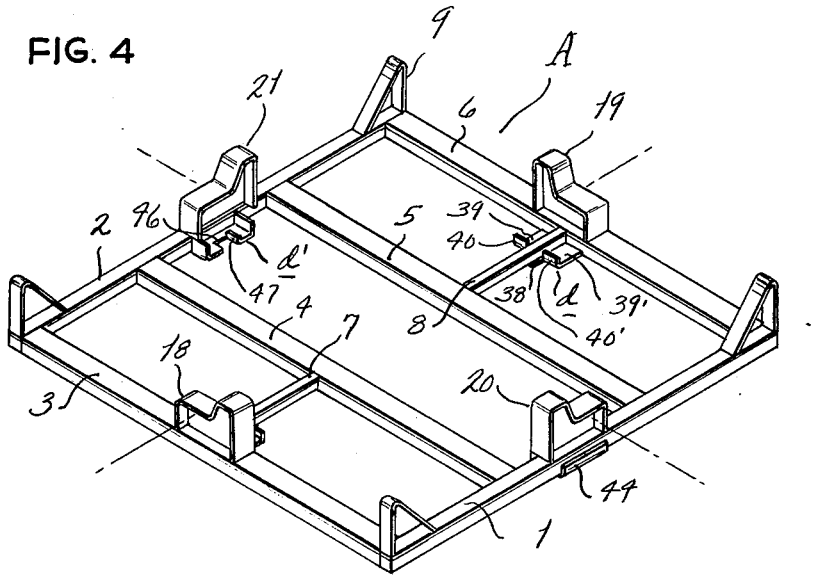
FIG. 4 is a perspective view of the pallet in inverted position.
Figure 10:
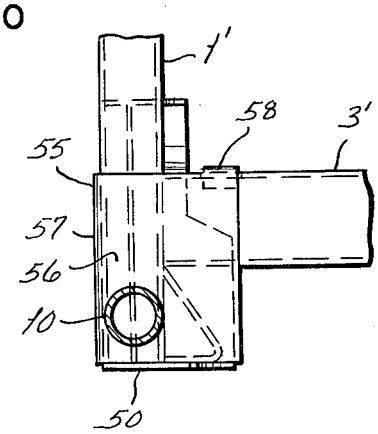
FIG. 10 is a horizontal transverse sectional view taken on the line 10—10 of FIG. 8.
Figure 11:
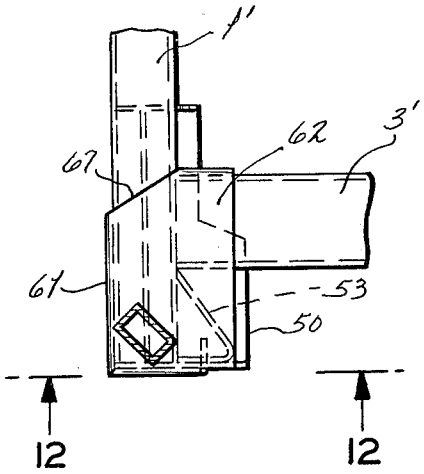
FIG. 11 is a transverse sectional view taken substantially on the line 10—10 of FIG. 8, but illustrating a modified form of a pallet constructed in accordance with and embodying the present invention, illustrating the relationship of the same to a tiering frame foot.
Figure 13:
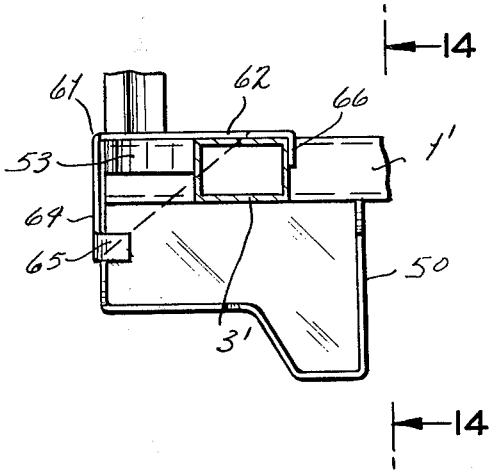
FIG. 13 is a vertical transverse sectional view taken on the line 13—13 of FIG. 12.
Figure 12:
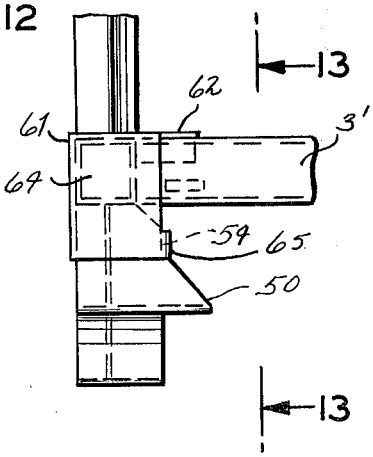
FIG. 12 is a fragmentary elevational view taken on the line 12—12 of FIG. 11.
Figure 14:
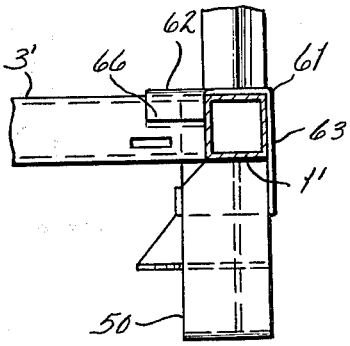
FIG. 14 is a vertical transverse sectional view taken on the line 14—14 of FIG. 13.

With particular reference to FIGS. 1 and 5, it is to be observed that bottom flange portions 32 provide bearing surfaces for disposition upon the end extensions 14, 14' of the underlying engaged top elements of tiering frame B when pallet A is utilized in tiered relationship to a similar pallet disposed upon the support surface. Thus, the said supports 18, 19, 20, 21 are so designed as to present the inclined portions 33 of edge flanges 28 in offset relation to the superimposed tiering frame posts 10, 11, as the case may be, so that when pallet A is disposed upon the engaged upper elements 12 of a pallet tiering frame B (see FIG. 5) the said inclined flange portions will be located laterally of the proximate leg extension 14, 14' and being of such length as to abut against the confronting side face of the extension 14, 14' in the event of shifting of the supported pallet A and thereby serve as a detent so as to inhibit further movement of pallet A in a direction effecting such abutment. Thus, inclined flange portions 33 prevent undesired shifting of a tiering frame-supported pallet so that stability is at all times obtained for such pallet and its load, as well as for any superimposed loads as developed through the tiered frames and pallets thereabove. Furthermore, said inclined flange portion 33 also has a camming effect in promoting proper disposition of a pallet A upon locked tiering frame upper elements. It will be appreciated that such pallets, together with their loads, are elevated by a fork lift truck which must then maneuver the same for proper address to the engaged upper elements before lowering the same thereon. Should there be an error in such presentation, wherein lower horizontal flange portions 34 inadvertently are brought into contact with the leg extensions 14, 14' only a slight shifting is required to permit said extensions 14, 14' to travel relatively in the manner of cam followers, along said inclined flange portions 33 to assure of reception of upper horizontal portions 32 thereon.

Furthermore, it is to be observed that supports 18 and 21 and 19 and 20 cooperate with their respective inclined flange portions 33, being directed toward the intervening standard 9, or as expressed in another manner, the inclined flange portions 33 on supports 18 and 19, and 20 and 21 are presented in opposite directions. This particular relationship further enhances the stability of a pallet A disposed upon engaged tiering frame upper elements since it limits rotational movement of such pallet A, that is, about a vertical central axis so that shifting is positively inhibited.

In view of foregoing it is apparent that supports 18, 19, 20, 21 uniquely adapt the metal pallet A for facile placement upon a tiering frame, as well as for assuring of marked stability in load-supporting condition.

Figure 2:
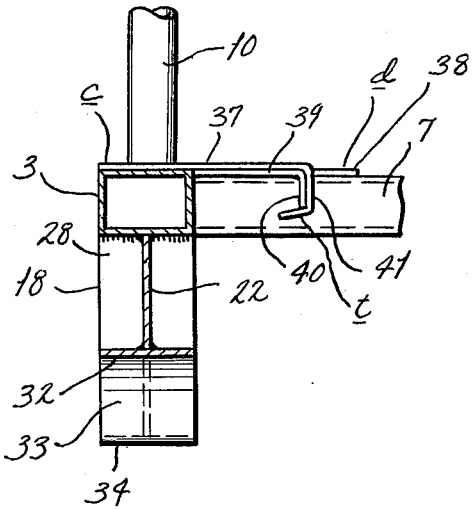
FIG. 2 is a vertical transverse sectional view taken on the line 2—2 of FIG. 1.
Figure 3:
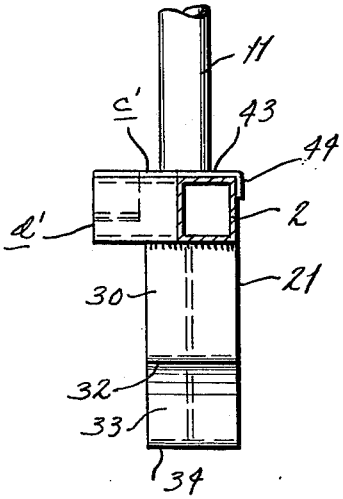
FIG. 3 is a vertical transverse sectional view taken on the line 3—3 of FIG. 1.

As developed more fully in the aforesaid U.S. Letters Patent No. 2,828,933, each post 10, 11 of each tiering frame component *b* is fixed at its lower end to foot structures *c, c'*, respectively, for engaging cooperating mounts *d, d'*, respectively, fixed on pallet A to effect a secured gripping, snap-on type engagement so as to counter the inherent bias of posts 10, 11 when the same are stressed into operative position. Foot structure *c* embodies a plate 37 for flatwise disposition upon the upper face of the related deck member 3, 6 and the adjacent portion of the associated mount *d;* which latter is of plate form, being rigid upon the adjoining portion of brace 7 and having a central tongue-like extension at its deck member remote end for defining with the adjacent end edge portions a pair of shoulders 39,39', with depending flanges 40, 40', respectively. Thus, said shoulders 39, 39' are presented on opposite sides of brace 7, 8, as the case may be. Said plate 37 of foot *c* at its inner end is provided with a pair of spaced-apart locking toes 41, 41' each having an inturned flange *t* at its lower end for extension beneath the respectively engaged shoulders 39, 39' (FIG. 2); and with said plate having a recess 42 intermediate said locking toes 41, 41' whereby the latter straddle the proximate brace 7,8 with their confronting or inner side edges abutting against the side faces of the proximate brace 7,

8, as the case may be. Thus, locking toes 41, 41′ prevent shifting of the associated post 10 in a direction normal to the longitudinal axis of the engaged deck member 3, 6 as well as inhibit any displacement longitudinally of said deck members.

Foot structure *c′* disposed at the lower end of each post 11 comprises a plate 43 for disposition upon the upper surface of the underlying stringer 1, 2 and the associated coactive mount *d′*; there being a depending flange 44 along the outer edge portion of each plate 43 for abutment against the outwardly directed side surface of the related stringer thereby inhibiting any movement of the related post 11 in a direction inwardly of pallet A. In its inner or opposite portion each plate 43 includes a central recess 45 aligned with a recess 46 within the underlying mount *d′* which latter is developed by a downturned flange 47 extending from one side edge of said recess 46 serving as a detent against a depending finger 48 from one side edge of plate recess 45. Thus, finger 48 restrains movement of the associated post 11 in a direction endwise of pallet A. Thus, mounts *d*, *d′*, which are fabricated preferably of plate stock and adhered, as by welding, to the pallet A are designed for cooperating with the particular foot structure *c*, *c′* of tiering frame components *b*, which latter are thus detachably engaged upon pallet A in the manner set forth in the aforesaid U.S. Patent which involves a mutual springing apart of the related posts 10, 11 for producing a stressed condition promoting reliable engagement upon pallet A.

Turning now to FIG. 6, A′ designates another form of pallet embodying the present invention which is formed of metal stock and comprises stringers 1′, 2′ and deck members 3′, 4′, 5′, 6′ which substantially correspond to like stringers and deck members of pallet A, but with the exception that end deck members 3′, 6′ are positioned inwardly of the ends of stringers 1′, 2′ and deck members 4′, 5′ are of slightly reduced cross-section than the corresponding elements of pallet A, although the latter is understandably a matter of choice since the particular size of the stringers is not critical. At each end of each stringer 1′, 2′ there is provided a support 50 which is generally of like construction as supports 18, 19, 20 and 21 hereinabove described in conjunction with pallet A so that like constituents will bear like reference numerals. It will thus be seen that lower flange portions 34 serve as bases for maintaining pallet A′ in supported disposition upon a surface, such as the ground, flooring, or the like, and with said bases being located inwardly of the adjacent end of the related stringer 1′, 2′ so that end flange portion 29 projects at its upper end, as at 51, above the associated web 22 for affixation, as by welding, to the adjacent end face of the related stringer. It is to be further noted that inclined flange portions 33 are in each instance directed toward the proximate end of pallet A′ so that the supports 50 at each end of the same stringer will have their inclined flange portions 33 directed away from other. The upper horizontal portion 32 of each bottom flange 31 on its inner portion is provided with an extension 52 for enhancing the bottom area of said flange portion. Fixed upon each stringer 1′, 2′, on its side face portion between the proximate end deck member 3′, 6′, as the case may be, and the end extremity of said stringer, being along the upper portion thereof, is a brace element 53 which projects inwardly of pallet A in partial overlying relationship to flange extensions 52 and inwardly beyond the proximate side edge of end flange portion 29 to define therewith a recess 54 for purposes presently appearing.

Pallet A′ is adapted for utilization with a tiering frame B′ which is also set forth and described in the aforesaid U.S. Patent No. 2,828,933 and thus comprised of a pair of interengageable, identical tiering frame components *b′* adapted for detachable snap-on gripping engagement of pallet A′. Tiering frame B′ is of the so-called corner post type, that is, wherein the uprights or posts are located at the corners of the pallet and said frame B′ comprises elements which correspond to components of tiering frame B above described so that such elements will bear like reference numerals.

At the lower ends of each upright or post 10, 11 of each tiering frame component *b′* there is provided a like foot structure 55 which embodies a plate 56 for supported disposition upon the upper surface of the underlying stringer 1′ or 2′, brace element 53, and the adjacent portion of the proximate deck member 3′ or 6′. Along its laterally outer side, plate 56 is provided with a depending flange 57 for abutment on its inner face against the contronting outer surface of the associated stringer 1′,2′, as the case may be. On its inward end edge, spacedly inwardly from the associated stringer 1′, 2′, each plate 56 is formed to present a downturned locking toe 58 having a returningly endwise bent distal section 59 for reception within an aperture 60 formed in the adjacent deck member 3′, 6′.

Accordingly, flanges 57 and locking toes 58 respectively inhibit shifting of the related posts against movement inwardly and endwise of pallet A′ in effectively resisting the bias developed through the stressing requisite for securing said tiering frame components *b′* in position upon said pallet A′. It is recognized, as brought out in the aforesaid Patent, that the legs 10, 11 of each tiering frame component *b′* will, when in detached condition, be urged toward each other at their foot carrying ends so that an outward springing action is required for mounting. Thus, pallet A′ is uniquely constructed for interengagement with the related foot constructions of tiering frame B′ as well as for facile disposition upon interengaged upper elements 12 of an underlying tiering frame B′. It will thus be seen that the under surface of each support 50 as developed by flange portions 32 and the adjacent extensions 52 provide a suitable bearing for disposition upon leg extensions 14, 14′ and with inclined flange portions 33 preventing rotative shifting of pallet A′ as disposed upon the underlying upper element 12.

FIGS. 11–14, inclusive, illustrate another form of tiering frame foot construction, as at 61, for use with a tiering frame of the corner post type, such as frame B′ above described, for effecting engagement upon pallet A′. Said foot construction 61 incorporates a flat plate 62 for supported disposition upon the upper surface of the underlying stringer 1′ or 2′, brace element 53 and the adjacent portion of the proximate deck member 3′ or 6′. Along its laterally outer side, plate 62 is provided with a depending flange 63 for abutment on its inner face against the confronting outer surface of the associated stringer 1′, 2′; which flange 63 is continuous with an end flange 64 abutting against the end of the associated stringer and with there being an inturned toe 65 at the lower end of said flange 64 which is planarwise parallel to flange 63. Said toe 65 projects into recess 54 of the proximate support 50 for bearing on its laterally outwardly directed face against the adjacent edge of support flange 29. On its inward end edge spacedly from the associated stringer 1', 2', each plate 62 is formed to present a downturned locking toe 66 which abuts against the adjacent side face of the proximate deck board 3' or 6' as the case may be.

From the foregoing it is apparent that foot 61 provides a four-point contact with pallet A' so as to conclusively inhibit shifting in any direction of the associated tiering frame component. To facilitate disposition of foot construction 61 upon pallet A', the normally inner end edge thereof may be partially cut away as at 67.

From the foregoing it is accordingly manifest that pallet A' is uniquely constructed for permitting of locking engagement with tiering frame foot constructions of varying types; exhibiting thereby as unusual versatility.

Having described our invention what we claim and desire to obtain by Letters Patent is:

1. The combination with a pallet for storage and transportation purposes comprising means defining a load supporting deck having four sides, a support member affixed to each side of said deck intermediately thereof and depending therefrom, each support member having a bottom edge comprising upper and lower horizontal linear portions there being an intermediate linear portion interconnecting said upper and lower linear portions, of a tiering frame comprising a plurality of substantially vertical posts corresponding in number to said pallet support members, means detachably engaging the lower ends of said posts upon said pallets immediately above a respective support member, a substantially horizontal top member having legs each of which is fixed proximate its outer end upon a post, each leg having an extension projecting beyond the related post, the upper linear portion of each support member being of greater length than the horizontal cross section of the leg extensions of said top member whereby upon disposition of a pallet upon a tiering frame top member the support members of such overlying pallet will be received upon the upper surfaces of the respective end extensions of the tiering frame top member therebelow permitting limited linear shiftability of such pallet without loss of engagement with said leg end extensions, the intermediate linear portions of support members on two adjacent sides of said deck being directed toward one corner of said deck and the intermediate linear portions of the other two support members being directed toward the corner of said deck diagonally opposite said one corner whereby said intermediate portions of said support members cooperate with the accepted tiering frame and extensions to stabilize the supported pallet against displacement.

2. The combination as defined in claim 1 and further characterized by said support member upper and lower horizontal linear portions being mutually offset with said intermediate linear portion being disposed therebetween, the vertical distance between said upper and lower horizontal portions being greater than one-half the vertical cross-section of the leg end extensions of the engaged top member.

3. The combination as defined in claim 1 and further characterized by said upper and lower horizontal linear portions being mutually offset with said intermediate linear portion being located therebetween, said intermediate portion being of such extent for abutment against a portion of the side of the supporting leg end extension on the adjacent tiering frame post to inhibit displacement of the pallet in a direction toward such adjacent post.

4. The combination as defined in claim 1 and further characterized by said lower horizontal linear portion being of less extent than said upper horizontal linear portion.

5. The combination as defined in claim 1 and further characterized by said upper and lower horizontal linear portions being axially parallel.

6. The combination as defined in claim 5 and further characterized by said intermediate linear portion being axially inclined downwardly and away from the adjacent end of said upper horizontal linear portion for establishing a directing surface with respect to engagement with the respective leg end extension of the supporting tiering frame top member.

7. A material supporting pallet adapted for use with a pallet tiering assembly comprising a load supporting deck including a rectangular peripheral frame having four elongated side members; a support element rigidly affixed to each of said side members approximately midway between the respective ends thereof for supporting said deck in a stable fashion above the ground when the pallet is set thereon and for supporting said deck on a pallet tiering assembly in a stable fashion when the pallet is set thereon; each of said support elements having a bottom periphery consisting solely of: a relatively short first surface extending substantially parallel to the plane defined by said peripheral frame, a relatively long second surface extending generally parallel to said first surface and being located between the plane defined by said first surface and the plane defined defined by said peripheral frame, said first and second surfaces having mutually proximate and mutually remote ends said mutually remote ends being free, and there being a lateral gap between the mutually proximate ends of said first and second surfaces, a camming surface bridging said gap and extending between said first and second surfaces and being oblique thereto; whereby when said pallet is placed on the ground, said first surface supports the pallet, and when the pallet is placed upon a pallet tiering assembly, the contacted portion of the latter will be caused laterally by the said camming surface for ultimate supporting engagement with said second surface; the camming surfaces of two of said support elements being directed toward one corner of said frame and the camming surfaces of the remaining two support elements being directed toward the corner diagonally opposite said one corner whereby said camming surfaces of said support elements cooperate to stabilize said pallet when said pallet is placed upon a pallet tiering assembly.

8. A material supporting pallet as defined in claim 7 and further characterized by standards rigidly affixed to the underside of said peripheral frame adjacent each corner thereof and having a ground-engageable surface substantially co-planar with said first surfaces of said support elements.

* * * * *